US006976511B2

(12) United States Patent
Covelli

(10) Patent No.: US 6,976,511 B2
(45) Date of Patent: Dec. 20, 2005

(54) METHOD FOR THE CONTROL OF A WEFT YARN FEEDING DEVICE IN A YARN PROCESSING SYSTEM, AND YARN PROCESSING SYSTEM

(75) Inventor: Marco Covelli, Occhieppo Inferiore (IT)

(73) Assignee: Iropa AG, Baar (CH)

( * ) Notice: Subject to any disclaimer, the term of this patent is extended or adjusted under 35 U.S.C. 154(b) by 113 days.

(21) Appl. No.: 10/257,001

(22) PCT Filed: Apr. 9, 2001

(86) PCT No.: PCT/EP01/04055

§ 371 (c)(1),
(2), (4) Date: Jan. 17, 2003

(87) PCT Pub. No.: WO01/77425

PCT Pub. Date: Oct. 18, 2001

(65) Prior Publication Data

US 2003/0145899 A1 Aug. 7, 2003

(30) Foreign Application Priority Data

Apr. 7, 2000 (DE) ..... 100 17 466

(51) Int. Cl.[7] ..... D03D 47/36

(52) U.S. Cl. ..... 139/452

(58) Field of Search ..... 139/452, 1 E, 435.1, 139/450, 273, 336.4, 370.2

(56) References Cited

U.S. PATENT DOCUMENTS 5,119,998 A 6/1992 Tholander et al.
5,285,821 A * 2/1994 Fredriksson ..... 139/452

FOREIGN PATENT DOCUMENTS

EP 0 114 339 B 6/1987
WO WO 89/08600 9/1989

* cited by examiner

*Primary Examiner*—John J. Calvert
*Assistant Examiner*—Brian Kauffman
(74) *Attorney, Agent, or Firm*—Flynn, Thiel, Boutell & Tanis, P.C.

(57) ABSTRACT

A yarn processing system includes a weft yarn feeding device with a control unit and a power loom which consumes weft yarn. In operation, a run-signal is generated by the power loom that initializes the start-up of the weaving operation. A start-signal that is derived from the run-signal is transmitted to the feeding device. The start-signal is generated externally of the feeding device. The drive motor of the feeding device is driven at a predetermined speed, after receiving the external start-signal in order to prevent an undesired reduction of the size of a yarn store by the initial consumption demand of the start-up of the weaving operation of the power loom. A signal transmitting connection is provided in the yarn processing system between the power loom and a control unit of the feeding device for transmitting the start-signal. On start-up of the power loom, the drive motor of the feeding device is operated at a predetermined speed by the control device independent from the size of the yarn store in the feeding device.

23 Claims, 3 Drawing Sheets

METHOD FOR THE CONTROL OF A WEFT YARN FEEDING DEVICE IN A YARN PROCESSING SYSTEM, AND YARN PROCESSING SYSTEM

FIELD OF THE INVENTION

The invention relates to a method for controlling a weft yarn-feeding device and a yarn processing system. The yarn processing system includes a weft yarn feeding device, a power loom which consumes weft yarn and a control device. In operation, a drive motor of the yarn feeding device is switched on and off and is accelerated or decelerated, respectively, in response to control signals, in order to maintain in the yarn feeding device a yarn store size related to the yarn consumption.

BACKGROUND OF THE INVENTION

Weft yarn feeding devices used in modern power looms (jet looms, gripper looms, projectile looms, or other types) frequently are autonomic units controlling the speed of the drive motor of the winding element essentially independent from the weaving operation in the power loom and exclusively in dependence from the permanently detected size of the yarn store in the feeding device. The yarn store is permanently detected in order to generate control signals for the control device of the feeding device which control device switches on or switches off the drive motor or accelerates or decelerates the drive motor, in order to maintain a size of the yarn store sufficient to cover the consumption. In case that a yarn consumption results in a decrease of the size of the yarn store in relation to a predetermined reference size, then the drive motor either is switched on and accelerated or is only accelerated until the reference size at least partially is reached again. In case that the size of the yarn store increases in relation to the reference size, then the drive motor is decelerated or is switched off. The yarn store in the feeding device is monitored by sensors. The drive motor operates with a predetermined acceleration behaviour. Depending on the case of application of the feeding device a predetermined maximum speed may be set for the drive motor.

According EP 0 114 339 B, a common control device is provided for several weft yarn measuring feeding devices in a jet power loom. The common control device, depending on the weaving pattern, selects and controls only one feeding device. As all measuring feeding devices include yarn stop devices, a control routine is implemented using a preparation switch by which the yarn store is brought in each measuring feeding device to a maximum size prior to the start-up of the power loom. For this function, the drive motor is driven for a sufficiently long time period and then is stopped again. The normal control routine depending from the size of the yarn store is set out of function for the preparation phase. Furthermore, a start-up switch is provided in the power loom and upon actuation starts the weaving operation. The actuation of the start-up switch signals the control device of the measuring feeding devices so that each one will again operate with a control routine depending on the yarn store size detection. The stopping devices are brought into their respective release position in timed fashion and one by one by respective trig or trigger signals transmitted from the power loom. As soon as an under-sized yarn consumption is detected, the yarn store size monitoring device of the respective measuring feeding device responds and generates control signals to start the drive motor in order to replenish the yarn store. There is an unavoidable time delay between the start-up of the weaving operation in the power loom and the acceleration of the drive motor as controlled by the control device. Since the power loom rapidly reaches its full load operation and causes high start-up yarn consumption, the yarn store in the actuated measuring feeding device may be emptied, resulting in an operation disturbance.

A rapidly operating power loom equipped with one feeding device only, e.g. a water jet power loom, for processing a single weft yarn quality only causes upon start-up of the weaving operation extremely rapid high start-up yarn consumption possibly causing a quickly emptied yarn store due to the time delay between the start of the weaving operation or the occurrence of the run-signal, respectively, and the response of the drive motor of the feeding device depending on the initial yarn store size. This is not only true for power looms equipped with several measuring feeding devices or with one measuring feeding device only, but also for power looms being equipped with another type of a feeding device and/or with several feeding devices, in the case that the power loom produces a rapidly starting and strong start-up yarn consumption. This drawback can be avoided by extremely powerful and strongly accelerating drive motors of the feeding devices, i.e. by expensive special feeding devices. Such special feeding devices, however, generate undesirably high load for the respective yarn.

It is known in practice for measuring feeding devices used in fast jet weaving machines to switch on and to accelerate the drive motor after or in synchronism with the occurrence of the first trig signal output for the stop device and as transmitted after startup of the weaving operation of the power loom. However, since then the drive motor only starts at the same moment as the trig signal is transmitted or even later, in some cases there will not be sufficient yarn in the yarn store in order to cover the high start-up yarn consumption.

It is an object of the invention to provide a method of the kind as disclosed and a yarn processing system allowing to avoid an emptying of the yarn store in the feeding device despite a strong and rapidly increasing start-up yarn consumption by the weaving machine, and to achieve that function by commercial available feeding devices and in a structural simple way.

SUMMARY OF THE INVENTION

In accordance with the method the drive motor is driven at a predetermined speed already when the start-up of the weaving operation of the power loom takes place. For that reason the feeding device is apt to cover even a high start-up yarn consumption of the power loom without the danger that the yarn store will be emptied. Between the yarn windings wound on during the run-up phase of the drive motor substantially in synchronism with the start-up phase of the weaving operation and the initially starting high start-up consumption of the power loom a dynamic balance is achieved between yarn windings wound on and yarn windings wound off. By that floating balance condition an abrupt decrease of the yarn store by high start-up yarn consumption either is levelled out or is compensated for such that the yarn feeding device does not run into an emergency condition by desperately trying to not only cover the start-up yarn consumption but to reach a "safe" yarn store size. As soon as the yarn feeding device has mastered the high start-up yarn consumption the control routine depending on the yarn store size will take over and will nullify the control routine for the drive motor with the predetermined speed. In this way it is possible to reliably avoid the above-mentioned operation disturbances even with commercially available yarn feeding devices. In the yarn processing system it only has to be assured that the start-signal derived from the run-signal upon start-up of the weaving operation is transmitted to the control device and is considered by the control device such that the drive motor already will run at the predetermined speed when in an overlapping fashion the size of the yarn store starts to decrease rapidly. In order to achieve this function only slight modifications of reliable design principles of the yarn feeding device are needed, i.e., only preparations at the control side, which preparations do not influence the mechanical operation and reliability of the yarn feeding device.

At which point in time the usual yarn store size depending control routine for the drive motor will take over to then control the drive motor independent from any start-signals, is decided by the co-action between the feeding device and the power loom. For example control signals depending on the yarn store size will take over the control of the drive motor upon their first occurrence or even after a predetermined and selectable time period after the emittance of the run-signal. For method reasons it is possible to set any influence of the yarn store size depending out of function for a predetermined period of time control signals for the control routine of the drive motor upon start-up of the feeding device. This is independent whether the control signals are generated by sensors either sensing the size or counting the wound-on and the withdrawn windings and calculating the size of the yarn store.

According to the method when the start-signal is transmitted, expediently, the drive motor of the feeding device in the special control mode is driven at the maximum allowable speed or at a speed close to the maximum allowable speed, e.g. at 55%–75% of Vmax, or at a speed already stored prior to a drive motor stop. The maximum allowable speed Vmax conventionally is pre-set at the yarn feeding device, particularly in view to the design and operation behaviour of the yarn feeding device and the conditions in the power loom, e.g. the weaving width, the yarn quality, the weaving cycle frequency, and the like. Setting of the predetermined speed for the motor is expediently made such that a floating balance condition between the windings wound on into the yarn store by the drive motor and the abruptly starting start-up yarn consumption is achieved in the dynamic phase caused by the start-up yarn consumption in the power loom. By the balance condition an overfilling of the yarn store or a too strong decrease of the size of the yarn store reliably will be avoided. Basically and according to the invention it is considered in common how the start-up of the power loom up to full load operation will take place and how the drive motor of the feeding device can accelerate.

The start-signal by which the drive motor is brought to the predetermined speed does not need to be transmitted when the run-signal for the weaving operation is emitted but it may be generated or may be considered by the drive motor with a predetermined advance or delay. This means that the start-signal timewise may be generated earlier or later than the run-signal, however, in any case will be derived from the run-signal. Overfilling or emptying of the yarn store can be avoided reliably by a precise or adaptive timing of the start-signal.

A delay of the start-signal relative to the run-signal particularly is expedient for a measuring feeding device having a stopping device, because the stopping device is actuated by a trig signal correlated to a predetermined rotational angle value in the power loom, and since the respective trig signal occurs timewise later than the run-signal. Depending from the condition of the mechanical components, e.g. clutches, in the power loom the time distance between the run-signal and the first trig signal may be of different magnitude or may increase after longer operation time of the power loom. A response of the drive motor to the start-up signal at the same time as the run-signal occurs was unable to consider these circumstances reliably enough, because then the drive motor may accelerate too early and for too long before the trig signal will release the stop device and before the start-up yarn consumption will become effective for the yarn store in the feeding device. In this case, the yarn store would overfill. In order to reliably avoid this disadvantage the time distance between the start-signal or the response to the start-signal, respectively, and the trig signal should be adapted to the actual conditions in the power loom. This is considered by a delay time between the run-signal and the start-signal or the point in time, respectively, at which the start-signal activates the drive motor. The delay time may be adjusted manually, e.g. by operator and after monitoring the run-up property of the measuring feeding device. Expediently, the adaptation is carried out adaptively by a self-learning program of the control device (of the yarn feeding device or of the power loom), during which program the time distance between the run-signal and the first trig-signal is measured and a delay time between the run-signal and the start-signal or the response to the start-signal is adjusted in dependence from the result of the measurement. The delay time can be adjusted either while deriving the start-signal from the run-signal, or by delaying the transfer of the start-signal to the drive motor, respectively. In this way, e.g. stepwise increasing time distances can be used which are called up from a table in order to adjust the delay time such that emptying and overfilling of the yarn store will be omitted, i.e. that an optimum floating transition will be reached from the run-up phase into the phase of the normal operation of the yarn processing system.

A standard equipment of a power loom may, e.g. in the control panel, contain a first switch by which the drive system is switched on. In this case the components of the power loom which are responsive to carry out the weaving operation do not move yet. Furthermore, a second switch, in most cases a green push button, is provided, when pressed generates the run-signal for the components of the power loom which have to carry out the weaving operation such that those components will rapidly start to move, e.g. by actuating respective clutches and/or gear transmissions. The second switch e.g. actuates an electric contact switch which in turn generates the run-signal. A signal transmitting connection transmitting the external start-signal to the feeding device expediently is connected with the electric contact switch. By this it can be achieved that the run-signal initiating the start-up of the weaving operation also is transmitted as the start-signal to the yarn feeding device, such that with the help of the control device in the yarn feeding device the drive motor substantially will run up in synchronism with the startup of the weaving operation.

In case that, upon occurrence of the start-signal, the drive motor is driven with maximum allowable speed, the speed adjustment device for the maximum allowable speed conventionally provided in the yarn feeding device may be employed to set the speed for this control routine. If, to the contrary, a lower speed is selected than the maximum allowable speed, for this reason expediently a separate speed adjusting device may be provided.

Expediently, the control device interferes at the control current side of a transistorised switching device of the power supply of the drive motor. In this case low control current values or control voltages, respectively, will suffice to switch on the drive motor. In a standardised fashion the control device is equipped with at least one microprocessor which takes care of the required control functions. The microprocessor is capable enough to also carry out the additional control routine for driving the drive motor upon emission of the start-signal as soon as the start-signal is transmitted to the microprocessor.

In a structurally simple way the start-signal is transmitted via a separate cable to the control device.

Alternatively, a wireless signal transmission from the power loom to the control device of the yarn feeding device or to the yarn feeding device may be possible.

A selectable advance or delay of the start-signal in relation to the run-signal can be achieved in a structurally simple way by a parallel switch which is actuated together with the contact switch but responds earlier or later than the contact switch. An advance may be expedient in order to match the run-up property of the yarn feeding device to the run-up property of the components in the power loom carrying out the weaving operation in order to substantially avoid in the dynamic run-up phase a drastic decrease of the yarn store size by the assisting interference of the drive motor. A delay may be expedient to avoid an overfilling. The advance or the delay expediently can be adjusted, e.g. in steps or steplessly.

In case that a computerised control system with a serial date communication is provided between the power loom and the feeding device, the run-signal may be given as the start-signal to the drive motor via the already present data transmission path.

The feeding device implemented at the power loom may be a measuring feeding device having a stopping device, or may be a feeding device operating with a yarn brake. The respectively implemented yarn feeding device type depends on the structure and the function of the power loom. Measuring feeding devices e.g. are implemented in case of jet power looms (air jet power looms or water jet power looms). To the contrary, feeding devices having an integrated yarn brake are implemented in gripper power looms, projectile power looms or other power loom types which do not need to measure the respectively inserted weft yarn length already by the feeding device, because the insertion arrangement of the power loom automatically will measure the correct length of the inserted weft yarn.

DETAILED DESCRIPTION

Figure 1:
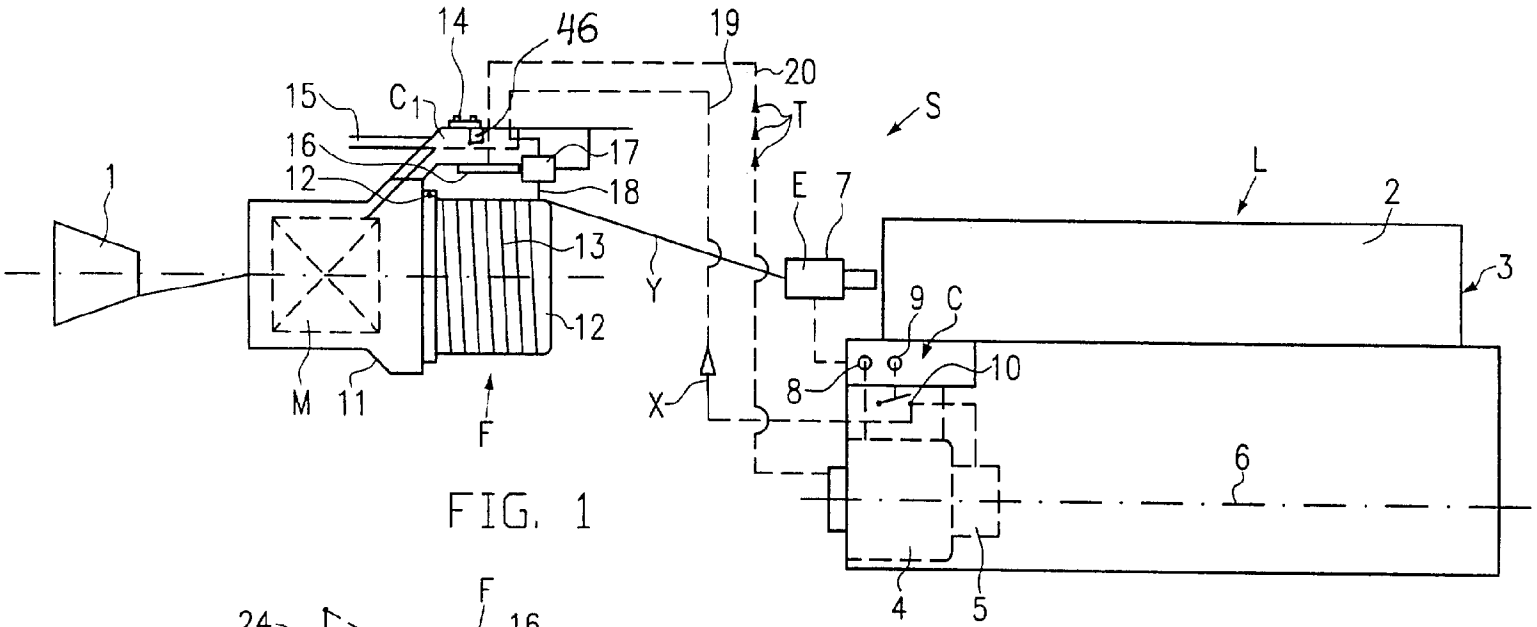
FIG. 1 shows a first embodiment of a yarn processing system.

A yarn processing system S in FIG. 1 comprises a power loom L, e.g. a water jet power or an air jet power loom, into which a weft yarn Y is inserted originating from a storage bobbin 1. The weft yarn is inserted into a weaving shed 2 and is woven into the fabric by components 3 carrying out a weaving operation (e.g. a shed forming mechanism, a weaving reed, a warp yarn mechanism, and the like).

The power loom L includes a drive system 4 driving a main shaft 6, and a drive sub-unit 5 for driving the components carrying out the weaving operation upon generation of a run-signal. The power loom L, furthermore, comprises an insertion arrangement E, e.g. a main nozzle 7 (and not shown, relay nozzles along the weft path through the weaving shed 2) which insertion arrangement pulls off the weft yarn Y from a weft yarn feeding device F. The control device C of the power loom L is associated to a control panel of the power loom L and includes a first switch 8 by which the drive system 4 can be switched on, and a second switch 9, by which the run-signal can be generated. An electric contact switch 10 is unified with the second switch 9 which contact switch 10 upon actuation of the switch 9 generates the run-signal which e.g. by means of the sub-unit 5 will initiate the weaving operation.

At least one yarn feeding device F is functionally associated to the power loom L. The feeding device F shown in FIG. 1 is a measuring feeding device which is designed to measure the respectively inserted length of the weft yarn. An electric drive motor M for a winding element 12 is provided in a housing 11 of the feeding device. The winding element 12 winds yarn withdrawn from the storage bobbin 1 into windings on a storage body 12. Those windings form a yarn store 13 from which yarn store the insertion arrangement E intermittently will pull off the weft yarn. The yarn feeding device F comprises an on-board or an associated control device C1 for the drive motor M. A speed adjusting device 14 may be provided at the control device C1. A power line 15 supplies electric power. A monitoring device 16 for the size of the yarn store 13 is provided in the yarn feeding device F. The monitoring device 16 includes at least one or expediently several sensors which transmit control signals to the control device C1 depending from the detected size of the yarn store 13. Furthermore, a stopping device 17 having an engageable and disengageable control element 18 is provided in the feeding device F for measuring the respective weft yarn length. The monitoring device 16 may comprise sensors, which either measure the number of wound on and pulled off windings and/or which detect an operation disturbance, e.g. a yarn breakage, respectively.

A signal transmitting connection 19 is provided between the electric contact switch 10 and the control device C1 of the yarn feeding device F for transmitting a start signal X to the control device C1. The start signal X is derived from the run-signal of the power loom L. Furthermore, a signal transmitting connection 20 may be provided from the power loom L to the control device C1 or the stopping device 17 to transmit so-called trig signals T to the control device C1. The trig-signals T are generated in dependence from the rotation of the main shaft 6 of the power loom L at a predetermined rotational angle position (e.g. by means of an encoder) to initiate the adjustment of the stop element 18 from the shown stop position into a retracted release position. The stop or control element 18 is adjusted by the control device C1 from the release position into the stop position shortly before a number of windings withdrawn from the yarn store 13 is reached which corresponds to the desired weft yarn length. A computerised control system having a serial data communication may be provided which also can be used for the transmission of the start-signal X.

Figure 2:
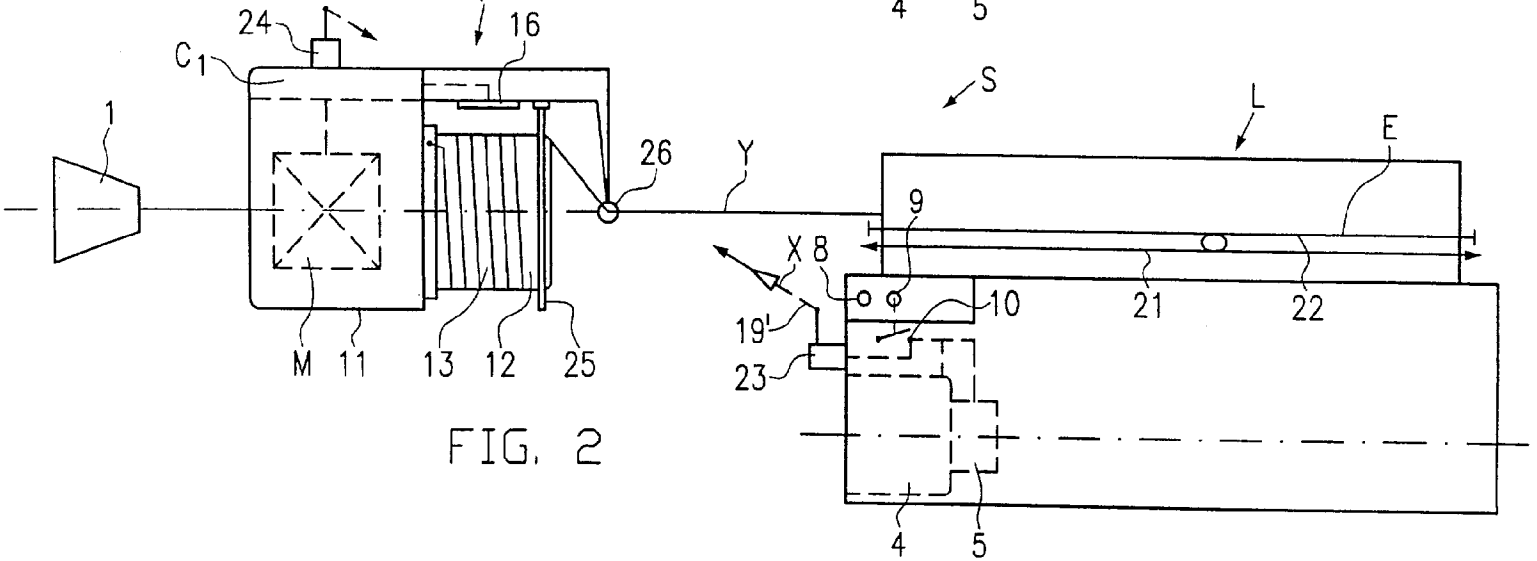
FIG. 2 shows another embodiment of a yarn processing system.

In the yarn processing system S in FIG. 2 the power loom L e.g. is a gripper power loom comprising a bringer gripper 21 and a taker gripper 22, both constituting the insertion arrangement of the power loom. Since the grippers 21, 22 automatically measure the withdrawn weft yarn length, the feeding device F does not need to have a stopping device for the weft yarn Y. A yarn brake 25, instead, co-operates with the storage body 12 for the yarn store 13. The withdrawn yarn runs through a withdrawal eyelet 26 downstream of the yarn brake 25 and towards the power loom L. In this case the connection 19' transmitting the start-signal X from the electric contact switch 10 of the switch 9 is shown as a wireless connection. The start-signal X is transmitted by means of an emitter 23 in a wireless fashion, e.g. in the form of a radio signal, to a receiver 24 of the control device C1 of the feeding device F. Moreover, the structure of the system in FIG. 2 broadly corresponds to the structure of the system shown in FIG. 1.

In the yarn processing system S in FIG. 1 or FIG. 2, respectively, the yarn feeding device F is switched on prior to a start of operation. Also the switch 8 in the power loom is actuated. A control routine may be stored in the control device C1 of the feeding device by which the drive motor M first will adjust a predetermined basic size of the yarn store 13. Then the drive motor is stopped. Upon actuation of the switch 8 the drive system of the power loom is activated. Components of the power loom responsive for weaving operations do not yet move. Subsequently the switch 9 is actuated which then generates the run-signal. The components of the power loom rapidly run to full action. A high start-up yarn consumption occurs rapidly. First when the main shaft 6 has rotated over a predetermined rotational angle a trig signal T for the stopping device 17 is emitted for the first time. The stop element 18 is retracted into the release position. The yarn consumption starts now. With the actuation of the switch 9, however, the start-signal X was transmitted to the control device C1. In response to the start-signal X the control device C1 switches on the drive motor substantially in synchronism with the beginning weaving operation and accelerates the drive motor to the predetermined speed, e.g. as adjusted at 14. New yarn Y already is wound on prior to the first actuation of the stopping device 17. Either with the later occurrence of first control signals from the monitoring device 16 and/or after expiration of a pre-set time duration, the drive motor control routine depending on the yarn store size will then overtake the regulation of the yarn store size for the subsequent course of the weaving operation.

Similarly in the yarn processing system S in FIG. 2 the drive motor M is switched on by the start-signal X and is initially brought to the predetermined speed.

This will be explained with the help of FIG. 3. In the upper part of the diagram in FIG. 3 the vertical axis represents the speed V or the number of revolutions, respectively, of the drive motor M and the drive systems 4, 5 of the power loom L. Both horizontal axes show the time or the rotational angle of the main shaft 6, respectively. In the lower part of the diagram the yarn store size (number W of windings) is shown on the vertical axis. At point in time t1 the switch 8 is actuated. The curve 27 represents the now running drive system 4 in the power loom. At point in time t2 the switch 9 is actuated, and the run-signal and the start-signal X are generated. The curve 28 represents the running of the components of the power loom carrying out the weaving operation. The curve 29 represents the acceleration phase of the drive motor M of the feeding device. The first trig-signal is emitted at point in time t3. First at point in time t4 the start-up yarn consumption occurring until then would have decreased the yarn store 13 so far that the monitoring device 16 would normally respond and cause a control signal to start the drive motor. If the drive motor would be switched on first at point in time t4 and depending on the yarn store size and would then be accelerated to maximum speed following the dotted curve 31, the yarn store could not be sufficiently replenished to cover the high start-up yarn consumption of the power loom. According to the invention, the drive motor already is started at point in time t2 by the start-signal X and is accelerated to a predetermined speed Vd which may be lower than the maximum limited speed Vmax. First at point in time t5 the yarn store size depending control routine takes over to then regulate the speed of the drive motor M in conformity with the curve 30.

Figure 3:
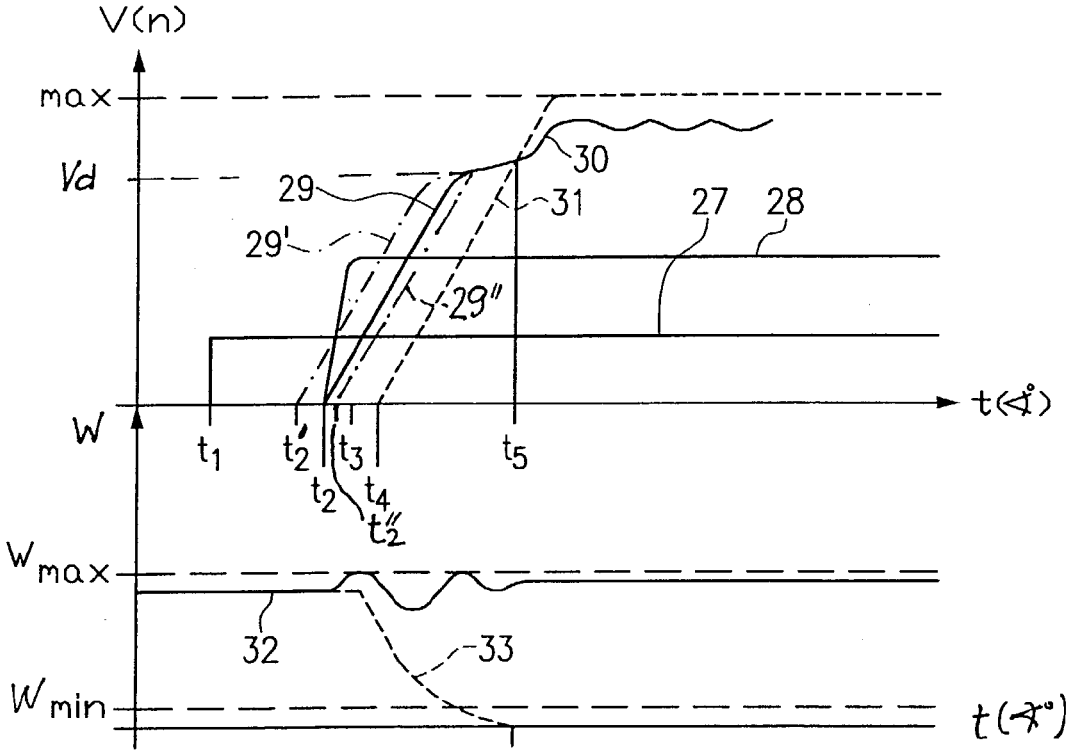
FIG. 3 shows a speed/time diagram and a yarn store size/time diagram.

In FIG. 3 alternatives are indicated, namely that the start-signal X for the drive motor M is generated at point in time t2' in advance of or at point in time t2" delayed with respect to the run-signal in order to drive the drive motor in accordance with the dotted curve 29' or 29", respectively.

The lower half of the diagram of FIG. 3 shows that the size of the yarn store 13 allowably varies between a maximum value Wmax and a minimum value Wmin first, and according to the curve 32 e.g. remains close to the maximum value. Shortly after the point in time t2, i.e. after switching on the drive motor M due to the transmitted start signal X, the size of the yarn store 13 increases to then again decrease due to the high run-up yarn consumption, before the yarn store size will oscillate and finally will remain close to the maximum size. If the drive motor M would not have been switched on at time t2 (or with an advance or a delay at t2' or t2", respectively), then curve 32 would continue along the dotted curve 33 and the yarn store would run empty due to the high start-up yarn consumption.

Since the drive motor M of the feeding device F is switched on with the start-signal upon start up of the weaving operation and is accelerated to the predetermined speed (to maximum allowable speed or to a speed close to the maximum allowable speed) winding on of new yarn material will start early such that in the dynamic run-up phase a floating balance condition will result between the high start-up consumption of the power loom and the already present windings plus newly wound on windings in the yarn store 13. By this balance condition it is avoided that the yarn store size will decrease drastically and/or that the yarn store even will be emptied. Herewith it is to be considered that the starting behaviour of the components carrying out the weaving operation in the power loom and the acceleration behaviour of the drive motor M do not allow an abrupt start of the full weaving capacity or abrupt acceleration to maximum speed, but that between both run-up procedures an intended dynamic co-operation occurs which reliably avoids drastic or critical decreases of the yarn store size.

Figure 4:
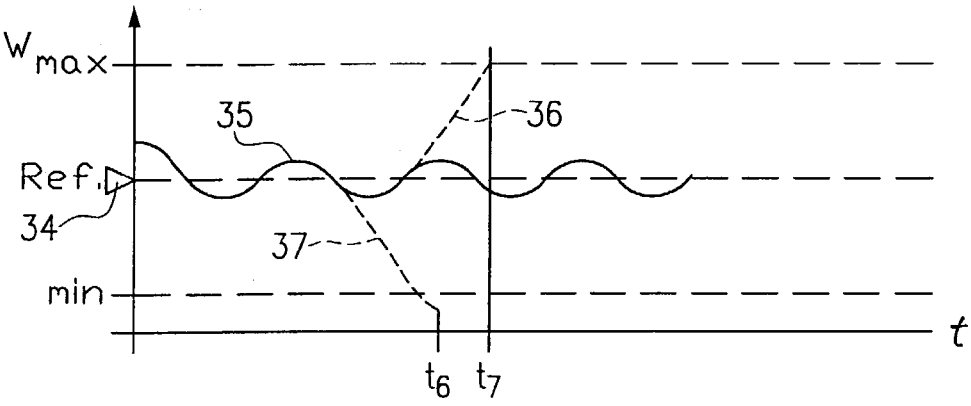
FIG. 4 shows a yarn store size/time diagram.
Figure 5:
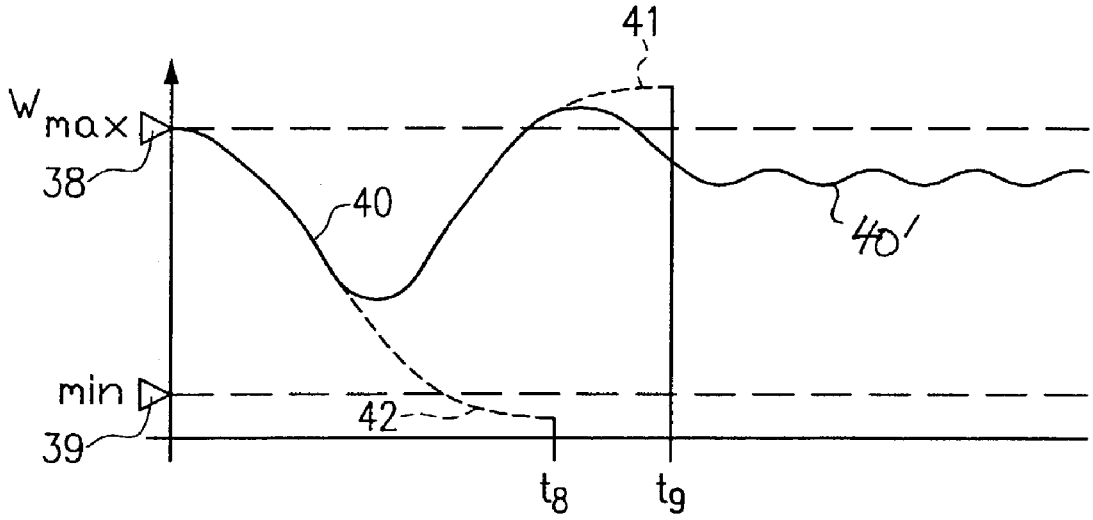
FIG. 5 shows another yarn store size/time diagram.

FIGS. 4 and 5 exemplarily indicate yarn store size depending control routines as conventional in yarn feeding devices, for clarity reasons, however, without the measures of FIG. 3.

In FIG. 4 the yarn store size (number W of windings) is shown on the vertical axis, while the horizontal axis is the time axis. Maximum and minimum yarn store sizes are predetermined which should not be exceeded (for too long a time) . A predetermined reference size 34 of the yarn store is determined and provided for a microprocessor of the control device Cl. Counting or registering sensors (not shown) count the number of windings contained in the yarn store 13 so that the control device C1 can control the drive motor such that the yarn store size e.g. follows a curve 35 which may oscillate about the reference size or may be raised or lowered somewhat upon demand, respectively. The dotted curve 37 indicates that the yarn store is emptied and will become emptied at a point in time t6, meaning that then the yarn feeding device would have to be stopped. The dotted line 36 indicates that the yarn store is overfilled and would become overfilled at a point in time t7, meaning that the yarn feeding device would have to be stopped. It is even possible to control the size of the yarn store without the reference sensor only by counting and calculating the wound on and the wound off windings and to control the drive motor accordingly. The yarn store size depending control routine as explained is replaced or overruled during run-up of the weaving operation by the earlier acceleration of the drive motor M, as shown in FIG. 3, in order to reliably cover the high run-up consumption of the power loom and to avoid operation disturbances (curves 36 or 37, respectively).

In FIG. 5 the yarn feeding device F e.g. is operating with a maximum size sensor 38 and a minimum size sensor 39 which generate control signals for the control device C1 in order to e.g. guide the development of the yarn store size along the curve 40. In this case the control device C1 includes an intelligent logic registering the excess of the maximum and minimum store sizes, which optionally considers the time durations of such excesses and which controls the drive motor such that the yarn store size remains below the maximum size and follows the curve 40'. The dotted curve 41 represents a not allowed overfilling which results in a stop of the yarn feeding device at point in time t9. The dotted curve 32 indicates an emptying of the yarn store resulting in a stop of the feeding device in point in time t8. The sensor 38, 39 could be combined with the reference sensor 34 of FIG. 4. Also the control routine of FIG. 5 will be replaced or overruled during run-up of the weaving operation, as shown in FIG. 3, by an advanced start of the drive motor M with the start-signal X in order to cope with the high run-up yarn consumption of the power loom.

Figure 6:
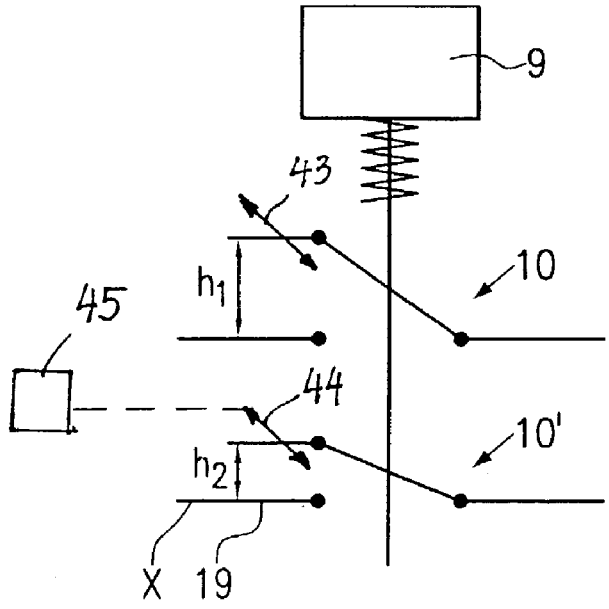
FIG. 6 shows a switch arrangement.

FIG. 6 shows the electric contact switch 10 which is actuated by the switch 9, e.g. a push button, in order to generate the run-signal and to start the components of the power loom carrying out the weaving operation, analogously to FIGS. 1 and 2. The contact switch 10 e.g. operates with a closure stroke h1 until the run-signal is emitted. Furthermore, a parallel switch 10' is provided which is actuated by the switch 9, as soon as the contact switch 10, e.g. by means of a relay, is closed. The parallel switch 10' operates by a closure stroke h2 which is smaller than the closure stroke h1 of the contact switch 10, or the contact switch 10' reaches its closing position earlier. Upon actuation of the switch 9 the parallel switch 10' is closed in advance to the contact switch 10 such that the start-signal X is produced with a timewise advance in relation to the run-signal for the power loom E, e.g. at point in time t2' in FIG. 3. By matching of both closure strokes h1 and h2 the magnitude of the advance may be set or varied or respectively.

At least one closure stroke h1 and/or h2 may be adjusted (arrows 43, 44) e.g. by means of a manual actuator 45. In this way the timing or the advance or the delay of the start-signal X can be adjusted or varied respectively.

Alternatively the advance or the delay of the start signal X could be adjusted at the feeding device F. For this purpose FIG. 1 shows an arrangement 46 at the control device C1, by which arrangement 46, e.g. with the emission of the start-signal X at the same time as the run-signal, the start-signal X for the drive motor M is generated with advance or with delay or is output further with an advance or a delay, respectively. At a yarn feeding device not having a stopping device or at a yarn feeding device having a stopping device such adjustments can be carried out by an operator after observation of the control behaviour of the feeding device in the run-up phase upon demand. For this case, e.g. several time steps may be predetermined.

As a further alternative, the suitable timing by which the start signal X will switch on the drive motor M in the run-up phase could be adjusted by a self-learning program routine even automatically. The control device C1 measures (in FIG. 1 in the measuring feeding device F) the time duration between the occurrences of the run-signal and of the first trig-signal T which time duration depends from the condition of certain mechanical components in the power loom L. On the basis of the measured time duration, e.g. a delay time is automatically set with the help of several stepwise increasing time gaps, namely a delay time between the point in time of the run signal and the point time at which the start-signal X has to activate the drive motor M (or at which the start-signal X is considered by the control device C1). The same delay time automatically will be actualised for each new run-up phase. A practical value for the delay time e.g. may lie between 50 ms and 100 ms. It always is intended to switch on the drive motor M by the start-signal X just early enough prior to the first trig-signal T in order to avoid emptying of the yarn store due to the run-up yarn consumption, but also to exclude that the time duration between the consideration of the start-signal X and the first trig-signal T becomes so large that an overfilling of the yarn store cannot be excluded. Basically the point in time at which the drive motor M is activated by the start-signal X, is adjusted such that both critical conditions "emptying or overfilling" of the yarn store are avoided and that the mentioned floating transition from the run-up phase into the normal operation can be achieved in an optimum fashion.

What is claimed is:

1. Method for controlling a weft yarn-feeding device in a yarn processing system which includes a weft yarn feeding device and a power loom which consumes weft yarn at the start of a weaving operation, according to which method a drive motor of the yarn feeding device is switched on and switched off and is accelerated or decelerated, respectively, by a control device in response to control signals of a yarn-store size monitoring arrangement associated with the yarn feeding device in order to maintain, in the feeding device, a yarn store size sufficient to cover the yarn consumption after initial start-up of the weaving operation, said method comprising the steps of:

generating a run signal at a side of the power loom correlated to the start of the weaving operation;

deriving an external start signal for the yarn feeding device in a timed correlation to and from the run signal;

transmitting the external start signal to the control device of the yarn feeding device; and starting the drive motor of the yarn feeding device in response to the transmitted external start signal and driving the drive motor such that the drive motor is at a predetermined optimum speed prior to release of yarn by the yarn feeding device to prevent an undesirable decrease in yarn store size due to a high yarn consumption at the initial start-up of the weaving operation in the power loom.

2. Method as in claim 1, wherein after starting of the loom, normal control of the speed of the drive motor in the feeding device depending on the size of the yarn store begins after occurrence of yarn store size depending control signals or after expiration of a predetermined time period.

3. Method as in claim 1, wherein upon transmission of the external start signal, the drive motor of the feeding device is driven to the maximum allowable speed or to a speed close to the maximum allowable speed.

4. Method as in claim 1, wherein the start signal is generated in advance of the run signal.

5. Method as in claim 1, wherein the start signal is generated at the same time as the run signal.

6. Method as in claim 1, wherein the start signal is delayed in relation to the run signal, the delay being an adjustable time delay which is adjusted manually, mechanically or automatically by a self-learning program routine based upon the run-up behavior of the yarn store size control.

7. The method of claim 1, further including, after said step of starting the drive motor, controlling the speed of the drive motor of the yarn feeding device based upon the size of the yarn store.

8. The method of claim 7, wherein said step of starting the drive motor comprises starting the drive motor of the yarn feeding device in response to the transmitted start signal and driving the drive motor and the drive motor is at a predetermined optimum speed and new yarn is wound onto a storage body of the yarn feeding device prior to release of yarn by the yarn feeding device to prevent an undesirable decrease in yarn store size due to a high yarn consumption at the initial startup of the weaving operation in the power loom.

9. A yarn processing system comprising a weft yarn feeding device, a power loom, a drive motor in the feeding device, a control device for the drive motor, a monitoring arrangement for monitoring the size of a yarn store in the yarn feeding device and for generating yarn store size dependent control signals for the control device, a power loom drive system including components for carrying out a weaving operation, and a run signal generating switch at the power loom for initating a start of the weaving operation by a run signal, wherein a signal transmitting connection is provided between the power loom and the control device of the yarn feeding device for transmitting a start signal for the drive motor that is derived in timed correlation to and from the run signal of the switch, and wherein the control device is configured so that the drive motor, at the initial start-up of the weaving operation, is driven independently from the actual yarn store size with the occurrence of the start signal such that the drive motor is at a predetermined optimum speed prior to release of yarn by the yarn feeding device to prevent an undesirable decrease in the yarn store size due to a high yarn consumption at the initial start-up of the weaving operation.

10. Yarn processing system as in claim 9, wherein the switch comprises an electric contact switch to which the signal transmitting connection is connected.

11. Yarn processing system as in claim 9, including a speed adjustment device associated with the control device of the feeding device for adjusting the predetermined speed of the drive motor upon generation of the start signal.

12. Yarn processing system as in claim 9, wherein the control device is connected to a control current side of a transistorized switching device for a power supply of the drive motor.

13. Yarn processing system as in claim 9, wherein the signal transmitting connection comprises a cable extending from the switch to the control device.

14. Yarn processing system as in claim 9, wherein the signal transmitting connection comprises a wireless connection for a radio transmission including an emitter connected to the contact switch and a receiver connected to the control device.

15. Yarn processing system as in claim 9, wherein the signal transmitting connection comprises data transmitting paths of a computerized control system for serial data communication between the power loom and the feeding device and the run signal is transmittable as the start signal on the data transmitting paths, the computerized control system being associated with both the power loom and the feeding device.

16. Yarn processing system as in claim 9, including a parallel switch provided for generating the start signal, and said parallel switch is actuable by the run signal generating switch either in advance of, in synchronism with, or with a delay relative to the run signal.

17. Yarn processing system as in claim 16, including a manually actuable adjusting device for the adjustment of the relative advance or delay of the start signal.

18. Yarn processing system as in claim 9, wherein a self-learning program section is provided in the control device for automatically adjusting the delay of the start signal based upon the run-up behavior of the yarn store size control of the feeding device.

19. Yarn processing system as in claim 9, including a power switch for providing power to the power loom without activating the drive system thereof, and in response to actuation of the power switch, the control device controls the drive motor to provide a predetermined size for the yarn store of the weft yarn feeding device and then stops the drive motor.

20. Yarn processing system as in claim 9, wherein said control device is configured so that the drive motor is driven based upon yarn store size control signals generated by said monitoring arrangement after initial start-up of the weaving operation.

21. Yarn processing system as in claim 9, further including a stopping device including a control element which is movable into a stop position wherein said control element is engaged with the yarn in the yarn store to prevent withdrawal of yarn by the power loom and into a release position to allow withdrawal of the yarn from the yarn store by the power loom, said control device being configured so that said drive motor is at the predetermined optimum speed prior to release of yarn by said control element of said yarn feeding device.

22. Method for controlling a weft yarn-feeding device in a yarn processing system, the weft yarn feeding device including a control device for controlling a drive motor, the yarn processing system including a power loom for receiving and consuming weft yarn from the weft yarn feeding device in a weaving operation, said method comprising the steps of:

switching on the power loom without activating a drive system thereof;

in response to switching on of the power loom, operating the drive motor with the control device so that the drive motor provides said weft yarn feeding device with a yarn store having a predetermined size;

stopping the drive motor;

subsequently generating a run signal at the power loom correlated to a start of a weaving operation;

deriving an external start signal for the yarn feeding device in response to the run signal;

transmitting the external start signal to the control device of the yarn feeding device; and starting the drive motor of the yarn feeding device with the control device in response to the transmitted external start signal and driving the drive motor so as to reach a predetermined speed prior to an undesirable decrease in the size of the yarn store due to high yarn consumption by the power loom at start-up of the weaving operation.

23. The method as in claim 22, including the steps of:

subsequent to said step of starting the drive motor, monitoring the size of the yarn store and providing yarn store output signals in response to the size thereof; and switching on and off, and accelerating or decelerating the drive motor of the yarn feeding device based upon the yarn store output signals.

* * * * *